United States Patent [19]

Humpolik et al.

[11] Patent Number: 4,531,577

[45] Date of Patent: Jul. 30, 1985

[54] HEAT EXCHANGER WITH A PLURALITY OF INDIVIDUAL TUBULAR PARTS AND PROCESS FOR THE MANUFACTURE THEREOF

[75] Inventors: Bohumil Humpolik, Ludwigsburg; Vlastimil Kluna, Kornwestheim, both of Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 388,607

[22] Filed: Jun. 15, 1982

[30] Foreign Application Priority Data

Jul. 2, 1981 [DE] Fed. Rep. of Germany ..... 3126030

[51] Int. Cl.[3] ..... F28D 1/00

[52] U.S. Cl. ..... 165/150; 165/178; 285/382.2; 29/157.3 C

[58] Field of Search ..... 165/150, 178; 285/382, 285/382.1, 382.2, 157; 29/157.3 C

[56] References Cited

U.S. PATENT DOCUMENTS 1,931,467 10/1933 Young .
3,827,727 8/1974 Moebius .
4,061,367 12/1977 Moebius ..... 285/382.2

FOREIGN PATENT DOCUMENTS 2229032 12/1974 France .
720553 12/1954 United Kingdom .
787882 12/1980 U.S.S.R. ..... 29/157.3 C

*Primary Examiner*—William R. Cline
*Attorney, Agent, or Firm*—Schwartz, Jeffery, Schwaab, Mack, Blumenthal & Evans

[57] ABSTRACT

A heat exchanger wherein a plurality of individual tubular parts are connected with each other is provided having a common pressure element for tube connections arranged in a plane. According to FIG. 1, a pressure platen 6 is present, which consists of a material harder than that of the external tubular part and is equipped with a number of orifices 7 corresponding to the number of tube connections. The pressure platen 6 surrounds the outer and inner tubular parts inserted in each other, and the diameter of the orifices 7 is smaller, at least in part, than the external diameter of the outer tubular part. According to the process for the manufacture of the heat exchanger, all of the tube connections are produced simultaneously by means of pressing on the pressure platen. Each of the tube connections is effected by reducing the cross section by means of plastic deformation of at least the outer, tubular part, whereby a press fit of the tubular part is obtained.

11 Claims, 12 Drawing Figures

FIG. 5
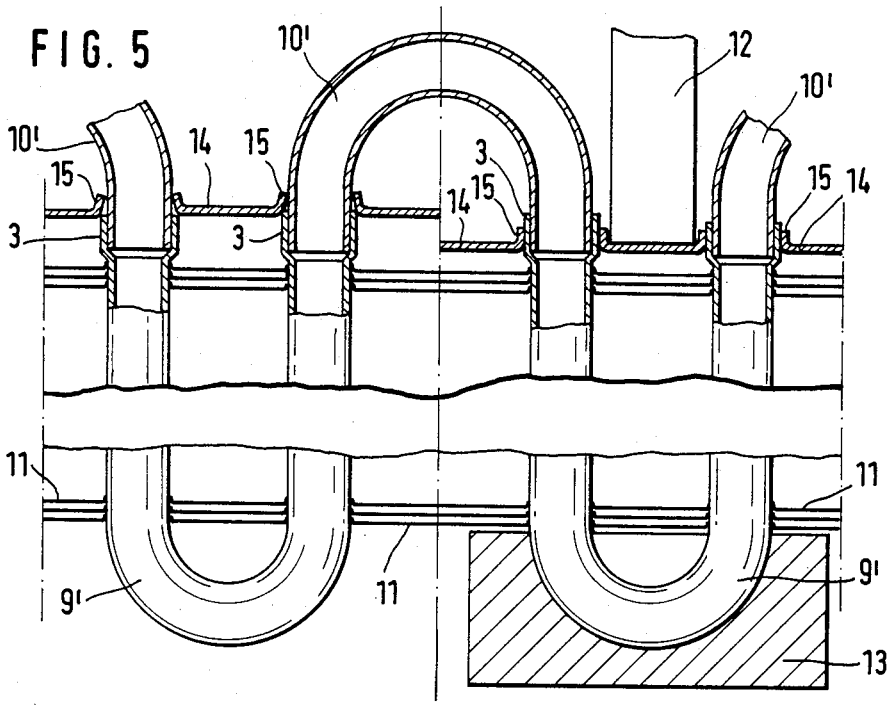
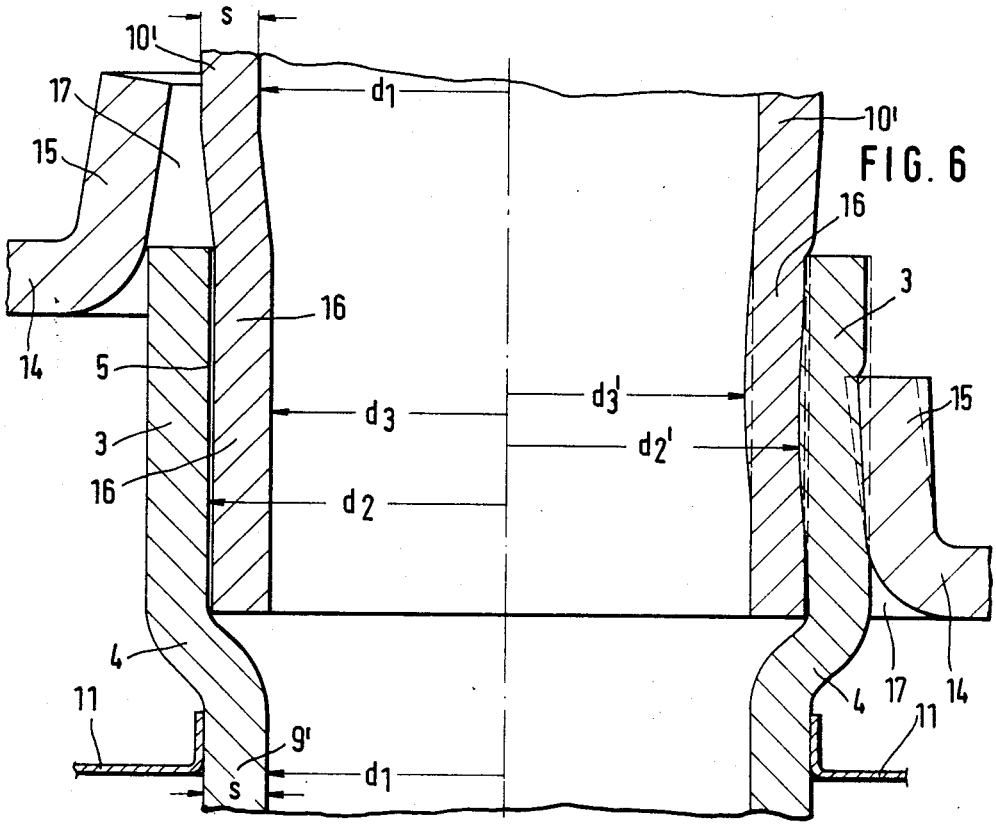
FIG. 6

FIG. 7
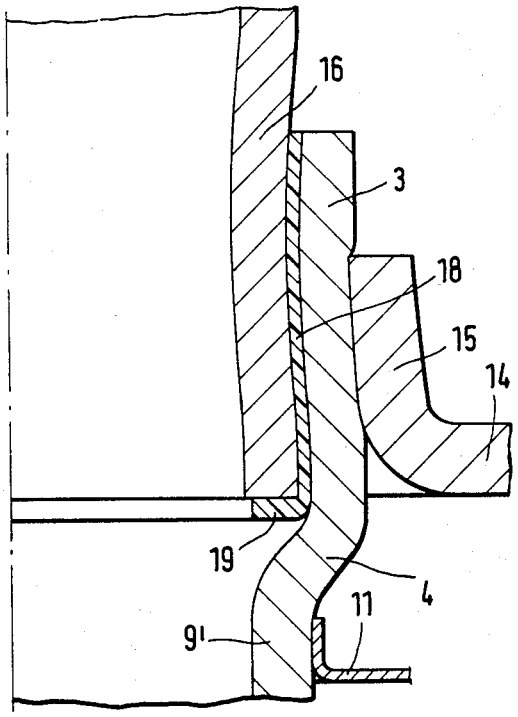
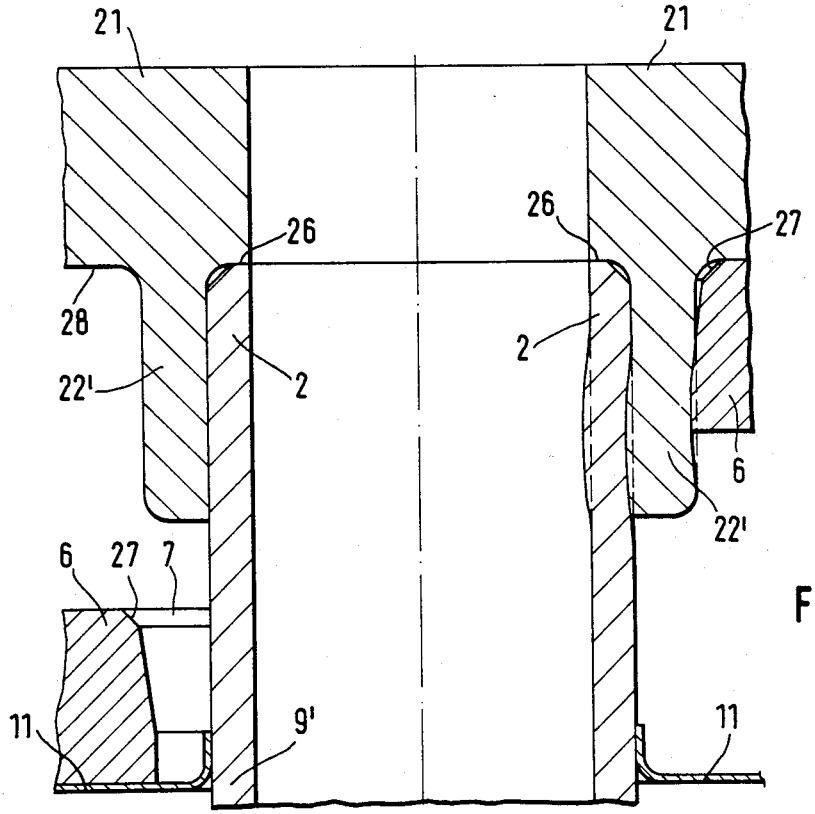
FIG. 9

HEAT EXCHANGER WITH A PLURALITY OF INDIVIDUAL TUBULAR PARTS AND PROCESS FOR THE MANUFACTURE THEREOF

BACKGROUND OF THE INVENTION

The present invention relates to a heat exchanger of the general type having a plurality of individual tubular parts connected with one another wherein the tubular parts are inserted into each other and are plastically deformed to obtain a press fit. The invention also pertains to a process for the manufacture of such a heat exchanger.

A method for joining tubular parts with the aid of an intermediate piece and for connection of a tubular part with a housing wall is known from British Pat. No. 720,553. The tubular parts have at their ends a flange, resting in a stepped bore of the intermediate piece or of the housing wall. A pressure ring surrounding the tubular part is pressed into the expanded part of the stepped bore. This results in a press fit between the housing or the intermediate piece and the pressure ring, which holds the flange against the stepped shoulder of the bore.

The joining of tubular parts in this manner is not suitable for mass production, because the use of intermediate pieces and the production of the tube flanges result in high costs. Furthermore, the pressing in of each individual pressure ring is highly labor-intensive and again leads to high costs. Application in heat exchangers with several rows of tubes is not possible because the tube connections of the inner rows of tubes are not accessible. The known tube joint therefore cannot be considered for heat exchangers.

SUMMARY OF THE INVENTION

It is therefore an object of the present invention to provide an improved heat exchanger.

It is a further object of the invention to provide a heat exchanger of the above-mentioned type, wherein a plurality of tube connections may be produced simultaneously in a simple manner, while insuring the tightness of the tube connections.

Another object of the invention resides in providing a heat exchanger wherein the joining of two tubes and the connection of a tube socket with a tube is accomplished in the same manner.

It is a further object of the invention to provide a process for the manufacture of a heat exchanger of this type.

In accomplishing the foregoing objects, there has been provided according to one aspect of the present invention a heat exchanger, comprising a plurality of inner tubular shaped elements; a plurality of outer tubular shaped elements, wherein one of the inner tubular shaped elements is inserted into each of the outer tubular shaped elements to produce a plurality of tube joints lying substantially in a single plane; a pressure platen having a number of orifices therethrough corresponding to the number of tube joints, wherein the pressure platen surrounds the inner and outer tubular shaped elements at the tube joints and the diameter of the orifices is at least in a portion thereof sufficiently smaller than the diameter of the outer diameter of the outer tubular shaped elements to produce a plastically deformed pressure fit between the inner and outer tubular shaped elements. In one preferred embodiment, the inner and outer tubular shaped elements originally have the same diameter and the outer tubular shaped elements comprise an expanded end having a conical transition which serves as a support for the inner tubular shaped elements, and in an alternative configuration, the inner tubular shaped elements comprise a reduced end inserted into the expanded ends, and the external diameter of the reduced ends corresponds to the internal diameter of the expanded ends. In another embodiment, the inner and outer elements have different diameters, with the external diameter of one tubular shaped element corresponding to the internal diameter of the other tubular shaped element.

In accordance with another aspect of the present invention, there has also been provided a process for the manufacture of a heat exchanger of the type as first described above, comprising the steps of passing the ends of the inner tubular shaped elements of each tube joint through the orifices of the pressure platen; inserting these ends into the ends of the outer tubular shaped element; thereafter moving the pressure platen in the direction of the outer shaped element, whereby in all of the tubular joints simultaneously a reduction of the cross section by means of plastic deformation of at least the outer tubular shaped element is effected, thereby attaining a press fit of the tubular shaped elements.

Also provided is a process for the manufacture of a heat exchanger according to the preferred embodiment described above, comprising the steps of passing the ends of the outer tubular shaped elements of each tube joint through the orifices of the pressure platen; expanding these ends; inserting the ends of the inner tubular shaped elements into the expanded ends of the outer tubular shaped elements; and moving the pressure platen onto the inserted ends to simultaneously reduce the cross section in all of the tube joints, thereby obtaining a pressure fit of the tubular shaped elements.

Further objects, features and advantages of the present invention will become apparent from the detailed description of preferred embodiments which appears below, when considered together with the attached figures of drawing.

BRIEF DESCRIPTION OF THE DRAWINGS

In the drawings:

FIG. 5 illustrates a variant of the embodiment according to FIG. 4;

FIG. 6 is an enlarged cross-sectional view of the tube joint according to FIG. 5;

FIG. 7 is a cross-sectional view of an arrangement according to FIG. 6, with a sleeve gasket inserted;

FIGS. 9 to 11 are variants of the embodiment of FIG. 8; and

DETAILED DESCRIPTION OF PREFERRED EMBODIMENTS

Figure 1:
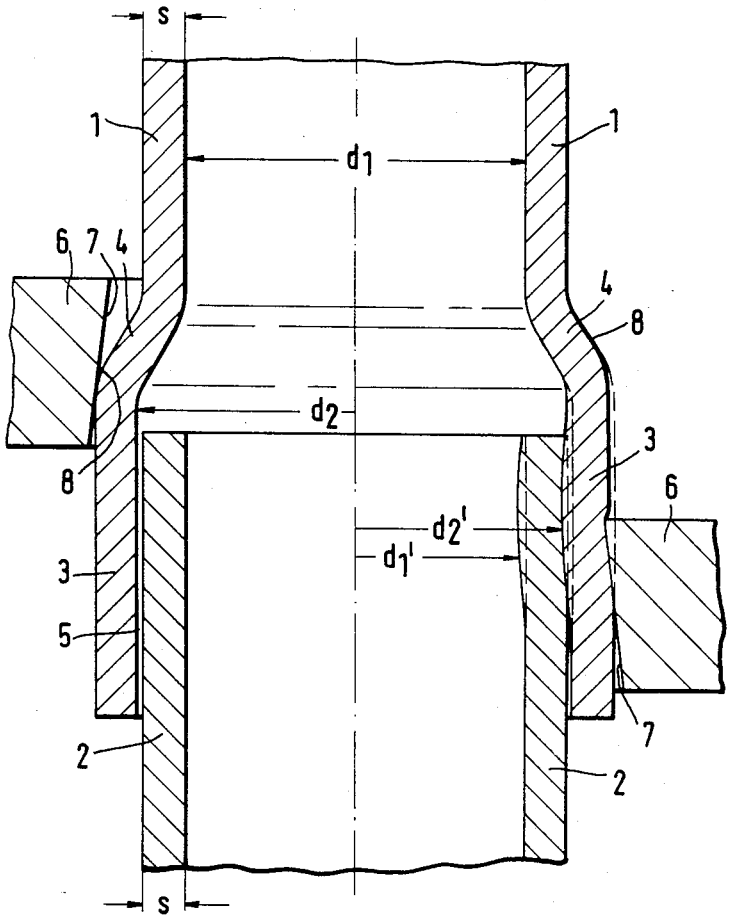
FIG. 1 is a cross-sectional view showing a joint of two tube ends in an enlarged view.

It is possible according to the invention to simultaneously produce all of the tube connections located in one plane, while a strong press fit of the tubes or tubular parts is obtained by means of plastic deformation. The pressure platen may be applied by tools of simple configuration. Furthermore, the pressing of the platen in locations of limited accessability is not difficult. The tightness of the joint is insured by the strong press fit of the tubular part.

The tubular parts may consist of straight tubes, forked tubes, tube elbows or connecting pieces or nipples of a connector box, since it is immaterial for the tube joint according to the invention whether two tubes are connected with each other, or a tube with a connecting piece. According to a preferred further development of the invention, the tubular parts to be joined originally are of the same diameter and the outer tubular part is an expanded end with a conical transition which serves to receive the inner annular part. This measure makes it possible to use tubular parts of the same diameter, so that no changes in cross section will occur in the transition from one tubular part to the other. The conical transition at the same time guarantees that the inner tubular part may be inserted only to a certain length into the outer tubular part. If only one end of the tube is to be processed, it is advantageous that the internal diameter of the expanded end correspond to the outer diameter of the undeformed inner tubular part. It is also possible, however, to provide the inner tubular part with a reduced end, to be inserted into the expanded end of the external tubular part, with the external diameter of the reduced end corresponding to the internal diameter of the expanded end. It is of advantage herein to render the proportional deformation in the reduction of the inner tube end larger than that of the expansion of the outer tubular part.

If it is desired that no deformation should be required for the assembly of the tubular parts, it is appropriate to use tubular parts with different diameters, with the external diameter of one tubular part corresponding to the internal diameter of the other tubular part. This measure eliminates the work step involved in reducing and/or expansion of the tube ends. Between the outer tubular part and the inner tubular part, a sealing sleeve may be arranged, this sleeve preferably being equipped with a radial collar, which secures the sleeve gasket in its position upon insertion of the tubular parts into each other.

The pressure platen may consist of metal or synthetic resin and may have different thicknesses. In thicker pressure platens, there are preferably arranged conical bores or cylindrical bores with conical inlet surfaces. Thinner pressure platens are appropriately provided with conical passages. In order to obtain a particularly strong plastic deformation in a certain area of the tube joint, it is advantageous to equip the pressure platen with a radially inwardly directed bead in each bore on the side of the least orifice cross section.

To provide better sealing between the tubular parts, the inner tubular part is equipped on its outer circumference or the outer tubular part on its inner circumference with circumferential grooves.

The process for the manufacture of the heat exchanger according to the invention is described in more detail below. In one preferred embodiment of the process for the production of the heat exchanger, one end of the tubular part is expanded, preferably to a bell shape. The press fitting of the pressure platen may be effected by means of pressure wedges or by an anvil and punch arrangement.

Exemplary embodiments of the heat exchanger and of the process for its manufacture are described hereinafter with the aid of the drawings.

In FIG. 1, the ends of two tubes 1, 2 are shown inserted in each other, with the left side of FIG. 1 showing the tube ends prior to their joining and the right side showing the tube ends in the completely installed state. In the case of the tube ends inserted in the manner of a telescope, distinction is made between the outer tube 1 and the inner tube 2. The outer tube 1 originally had the same internal diameter $d_1$ as the inner tube 2 and is expanded at its end 3, in the shape of a bell, to a diameter of $d_2$. The expansion produces a conical transition 4 between the sections of diameter $d_1$ and $d_2$. Both tubes 1, 2 have the same wall thickness s.

As seen on the left side, a slight gap 5 exists between the inner tube 2 and the expanded end 3, to facilitate the mutual ihsertion of the tube ends. A pressure platen 6 has a conical bore 7, the smallest diameter whereof is $>d_1+2$ s and $<d_2+2$ s and the largest diameter whereof is $>d_2+2$ s. The opening angle of the conical bore 7 is substantially smaller than the opening angle of the conical transition 4.

The outer tube 1 extends through the conical bore 7, with the cone of the bore 7 and the cone of the transition 4 extending in the same direction. The difference in the opening angles results in a butting face 8 for the pressure platen at the transition 4.

At the right side of FIG. 1, the arrangement is illustrated in the final assembled state. Herein the pressure platen 6 is located in the area of the expanded end 3 which receives the inner tube 2. Since the smaller diameter of the conical bore 7 is $<d_1+2$ s, the tubes are plastically deformed during the movement of the pressure platen 6 from its position shown at the left side to the position shown at the right side, so that the end 3 is reduced to a diameter $d_2'$ and the inner tube is reduced to a diameter $d_1'$. Since the diameter $d_2'$ is smaller than the external diameter ($d_1+2$ s) of the inner tube, the plastic deformation of the two tubes creates a strong press fit.

On the right side of FIG. 1, broken lines indicate the outlines of the inner tube 2 and of the expanded end 3 prior to the plastic deformation.

Figure 2:
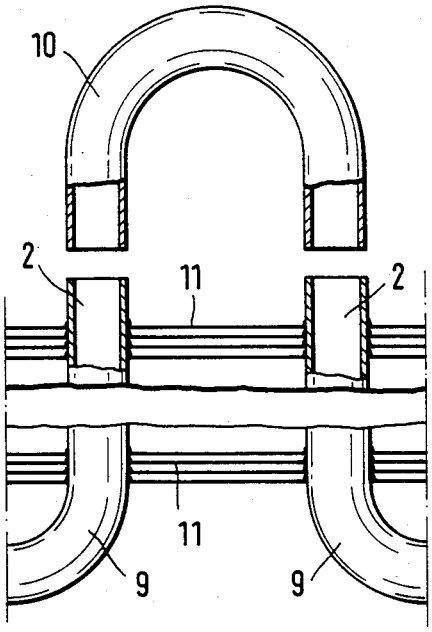
FIGS. 2 to 4 schematically illustrate the process steps for producing the tube joints of a heat exchanger.
Figure 3:
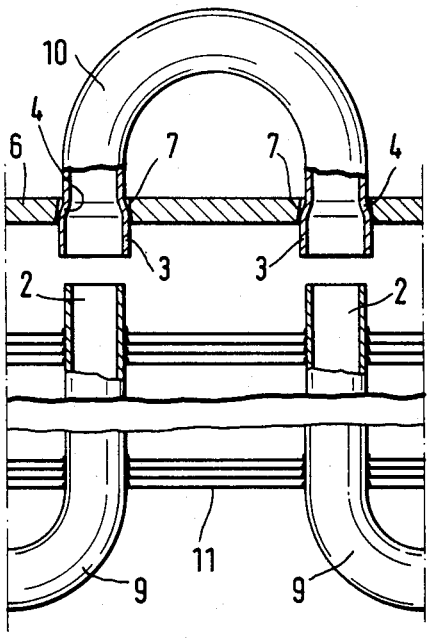
Figure 4:
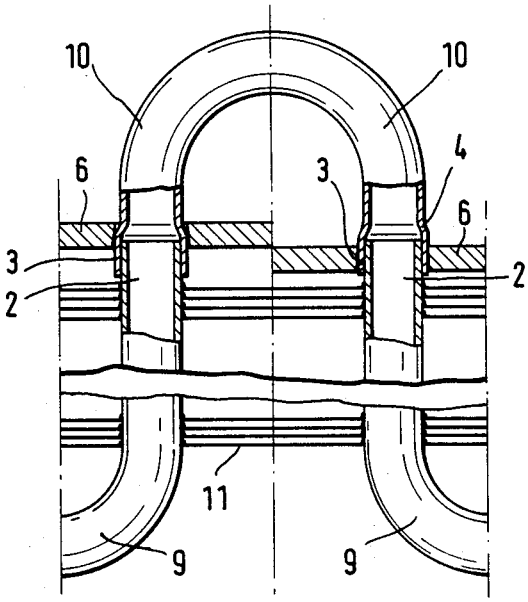

The most important process steps of the assembly of the tube joint shown in FIG. 1 are demonstrated in FIGS. 2 to 4. FIG. 2 shows a section of a heat exchanger block with ribs 11 and two tube forks 9 and a tube elbow 10, which is intended to establish the connection between the two tube forks 9. The free ends of the tube forks 9 are designated by 2, since they correspond to the inner tube 2 of FIG. 1. The tubular cross section of the tube forks 9 and of the tube elbow 10 are equal.

In FIG. 3, the tube elbow 10 is shown with expanded ends 3. It follows that the tube elbow 10 corresponds to the outer tube 1 in FIG. 1. Prior to the expansion of the ends 3, the ends of the tube elbow are inserted through the conical bores 7 of the pressure platen 6. After the expansion, the pressure platen rests on the butting surfaces of the conical transitions 4. The tube elbow 10 has not yet been placed on the ends 2 of the tube forks 9.

On the left side, FIG. 4 shows the arrangement with the tubes or tube ends 3 and 2 inserted, prior to plastic deformation. On the right side, the arrangement is shown in the final assembled state, i.e., the pressure platen 6 is moved dowhwardly and the press fit between the inner tube 2 and the expanded end 3 is effected. As the reference symbols are in agreement with those of the preceding figures and the arrangement has already been shown in detail in FIG. 1, FIG. 4 is not discussed further in order to avoid repetition.

FIG. 5 shows a section of a heat exchanger block consisting of tube forks 9', tube elbows 10' and ribs 11, with the left side again showing the arrangement prior to plastic deformation, and the right side illustrating the final assembled state of the tube joint, with a punch 12 and an anvil 13. In contrast to the arrangement according to FIGS. 2 to 4, the ends of the tube forks 9' are now equipped with expanded ends 3, into which the ends of the tube elbows 10', optionally tapered or reduced, are inserted. Furthermore, a pressure platen 14 of a different configuration is provided, which has conical passages 15 in place of the conical bore 7 of the pressure plateh 6. The pressure platen 14 is not pressed onto the expanded tube ends, but onto the tube pieces serving as inner tubes.

To produce a press fit in the tube joints, the pressure platen 14, as shown on the right side of FIG. 5, is moved onto the expanded end 3, with the passages 15 effecting the plastic deformation of the tubes in the connection region. The configuration and dimensions of the passages 15 correspond to the data of FIG. 1. The punch 12 serves to press the pressure platen 14; it acts on the pressure platen 14, while the heat exchanger block is held by the anvil 13.

FIG. 6 shows a section of the tube joint according to FIG. 5, enlarged. The left side of FIG. 6 shows the arrangement prior to the plastic deformation, and the right side shows the final assembled state of the tube joint. The tube fork 9', with a diameter of $d_1$, has an expanded end 3 with a diameter of $d_2$. The tube elbow 10' has an end 16 tapering to a diameter $d_3$, corresponding in its external circumference to the diameter $d_2$ of the expanded end 3, while leaving a slight gap 5. Naturally, the tapered end 16 is not required in such a case wherein the diameter $d_2$ is $>d_1+2$ s.

One of the ribs 11 of the heat exchanger block is indicated at the tube fork 9'. The conical passage 15 of the pressure platen 14 has an opening 17, approximately corresponding to the conical bore 7 of FIG. 1. The pressure platen 14 rests with the passage 15 on the upper edge of the expanded end 3.

On the right side of FIG. 6, the pressure platen 14 is in the area of the expanded end 3 which receives the tapered end 16. In view of the fact that the smallest diameter of the conical opening 17 is smaller than the external diameter of the expanded end 3, the tube ends are plastically deformed by the movement of the pressure platen 14 into this position, so that the end 3 is reduced to the diameter $d_2'$ and the end 16 to the diameter $d_3'$. Simultaneously, the passage 15 is expanded. In this manner a very strong press fit is created between the passage 15, the expanded end 3 and the tapered end 16. The outlines of the afore-mentioned parts prior to the plastic deformation are indicated by broken lines.

FIG. 7 shows a tube joint according to FIG. 6, wherein a sealing sleeve 18 is additionally arranged between the tube ends 3 and 16. To exactly position the sealing sleeve 18 prior to plastic deformation, it has a collar 19 extending radially inwardly.

Figure 8:
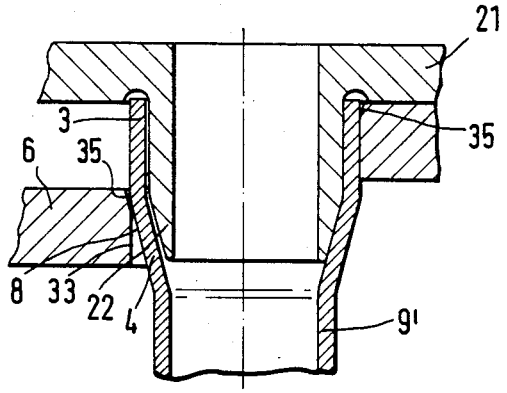
FIG. 8 is a cross-sectional view of a connection of a tube with a tube socket.

In FIG. 8, a sheet 21 is shown, equipped with a connecting piece 22 and having an expanded tube fork 9'. The expanded end 3 of the tube fork 9' is pushed onto the connecting piece 22. The pressure platen 6 has a cylindrical bore 33 with a butting surface 35, with the latter serving to center the pressure platen 6 during its movement. The left side of FIG. 8 shows the arrangement prior to joining, while the right side shows the final assembled state.

A variant of the connection of the tube fork 9' with a tube connecting piece 22' is shown in FIG. 9. Here again, the process steps prior to and after the plastic deformation are shown. The connecting piece 22' has an opening cross section corresponding to the external cross section of the end 2 of the tube fork 9'. At the foot of the connecting piece 22', the sheet 21 has a shoulder 26, serving as the stop for the tube fork 9'.

The pressure platen 6 is provided on the side with the larger cross section of the bore 7 with a counterbore 27. The counterbore 27 assures that the pressure platen 6 can fit well against a flat surface 28 of the sheet 21. On the right side, there again the outlines of the structural part prior to plastic deformation are indicated by broken lines.

Figure 10:
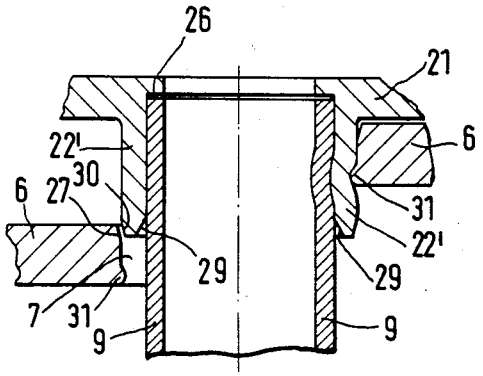

In FIG. 10, a sheet 21 with a connecting piece 22' is shown, with the sheet 21 forming a shoulder 26 at the foot of the connecting piece 22'. Again, the shoulder serves as the stop for the tube fork 9'. The edge of the connecting piece 22' is equipped both on the inner and the outer circumference conical butting surfaces 29 and 30. The butting surface 29 serves to center the tube fork 9 during its insertion in the connecting piece 22'. The butting surface 30 serves to center the pressure platen 6 on the connecting piece 22'. The pressure platen 6 has on the side of the smallest opening cross section of the conical bore 7 a radially inwardly directed bead 31. This bead effects a stronger plastic deformation of the connecting piece 22 and the tube fork end 2.

Figure 11:
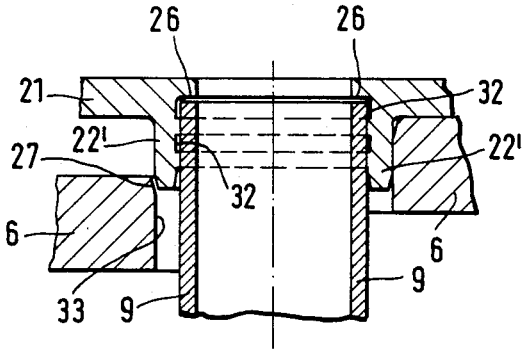

FIG. 11 shows an arrangement similar to FIG. 10. Only the differences will therefore be discussed. The connecting piece 22' is equipped on its internal circumference with several grooves 32 extending in the circumferential direction, provided to improve the seal between the connecting piece and the tube. As in the preceding figures, in FIG. 11 the different process steps are shown in the left and the right side of the figure.

Figure 12:
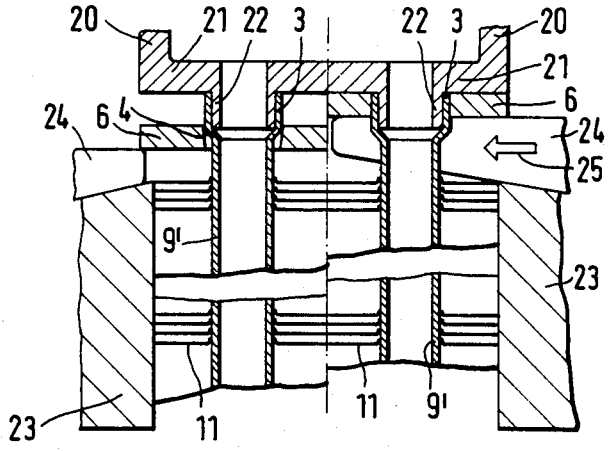
FIG. 12 is a cross-sectional view showing a tube/-sheet connection and a pressure tool.

In FIG. 12, a connection of the tube forks 9' with a water tank 20 is represented, with the left side and the right side displaying different process steps. A bottom wall or sheet 21 of the water tank 20 is equipped with tubular connecting fittings 22. The expanded end 3 of the tube fork 9' is placed over the connector fitting 22. The pressure platen 6 rests against the conical transition 4, as shown on the left side. The heat exchanger block, consisting of ribs 11 and the tube forks 9' is located in a press installation 23, equipped with pressure wedges 24. The right side of the figure demonstrates how, by the movement of the pressure wedges 24 in the direction of the arrow 25, the pressure platen 6 is urged against the bottom wall 21 of the water tank 20, whereby a pressure fit is created between the tubular parts (fitting 22 and the end 3).

Naturally, the invention is not restricted to the tube joints shown in the specific embodiments, but rather a series of combinations of the characteristics of the different figures is likewise possible.

What is claimed is:

1. A heat-exchanger, comprising:

a plurality of inner tubular shaped elements having enlarged end portions having an essentially cylindrical shape;

a plurality of outer tubular shaped elements having end portions having an essentially cylindrical shape, the inner diameter of said cylindrical end portions of said outer elements being approximately equal to the outer diameter of the cylindrical end portions of said inner elements, wherein the cylindrical end portion of one of said inner tubular shaped elements is inserted into axially overlapping position within the cylindrical end portion of each of said outer tubular shaped elements to produce a plurality of tube joints lying substantially in a single plane;

a pressure platen having a number of orifices therethrough corresponding to the number of said tube joints, wherein the pressure platen surrounds the inner and outer tubular shaped elements at said tube joints and the diameter of said orifices is at least in a portion thereof sufficiently smaller than the outer diameter of the cylindrical end portions of said outer tubular shaped elements to produce a plastically deformed pressure fit between said inner and outer tubular shaped elements, said pressure platen being positioned with orifice portions having a smaller diameter than the outer diameter of the cylindrical end portions of said outer tubular shaped elements disposed around the overlapping cylindrical end portions of the inner and outer tubular shaped elements between the free ends of the overlapping cylindrical end portions, and wherein the pressure fit comprises a radially inwardly directed deformation of both the inner and outer tubular shaped elements between the free ends of overlapping cylindrical end portions, the outer diameter of the inner tubular shaped element in the plastically deformed area of said pressure fit being smaller than the outer diameter of the remainder of the inner tubular shaped element.

2. A heat exchanger according to claim 1, wherein said pressure platen is comprised of a harder material than said outer tubular shaped elements.

3. A heat exchanger according to claim 1, wherein said inner and outer tubular shaped elements originally having the same dimater and the outer tubular shaped elements comprise an expanded end having a conical transition which serves as the support for the inner tubular shaped elements.

4. A heat exchanger according to claim 1, wherein said orifices in said pressure platen comprise cylindrical bores having a conical butting surface.

5. A heat exchanger according to claim 4, wherein said orifices in said pressure platen comprise conical bores having a radially inwardly directed bead on the side having the smallest opening cross section.

6. A heat exchanger according to claim 1, wherein said orifices in said pressure platen comprise conical passages.

7. A heat exchanger according to claim 1, wherein in each tube joint at least one surface selected from the external circumference of the cylindrical end portion of the inner tubular shaped element and the internal circumference of the cylindrical end portions of the outer tubular shaped element is provided with a plurality of circumferential grooves.

8. A process for manufacturing a heat exchanger comprising a plurality of tube joints between inner and outer tubular shaped elements, wherein said inner and outer tubular shaped elements originally having the same diameter, said process comprising the steps of:

passing the ends of a set of tubular elements selected from the set of outer tubular shaped elements and the set of inner tubular shaped elements through the orifices of a pressure platen having a number of orifices therethrough corresponding to the number of tube joints;

expanding the ends of said outer tubular shaped elements, the outer diameter of the expanded ends of said outer elements being larger than the diameter of at least a portion of said orifices of said pressure platen, and the inner diameter of the expanded ends of said outer elements being substantially equal to the outer diameter of the ends of the inner elements, the ends of both the inner and outer tubular shaped elements being cylindrical;

inserting the cylindrical ends of the inner tubular shaped elements into axially overlapping position within the expanded cylindrical ends of the outer tubular shaped element to produce a pluralty of tube joints lying in a single plane; and moving said pressure platen onto the overlapping ends of said outer and inner tubular shaped elements with orifice portions having a smaller diameter than the outer diameter of the cylindrical end portions of said outer tubular shaped elements disposed around the overlapping end portions of the inner and outer tubular shaped elements between the free ends of said overlapping cylindrical end Portions to simultaneously reduce the cross section in all of the tube joints, thereby obtaining a plastically deformed Pressure fit between said inner and outer tubular shaped elements, wherein said pressure fit comprises a radially inwardly directed plastic deformation of both the inner and the outer tubular shaped elements between the free ends of the overlapping cylindrical end portions, and the outer diameter of the inner tubular shaped element in the plastically deformed area of the pressure fit is smaller than the outer diameter of the remainder of the inner tubular shaped element.

9. A process according to claim 8, wherein said pressure platen is moved onto the overlapping ends of said outer and inner tubular shaped elements by placing the heat exchanger into a press installation subsequent to the insertion of the inner and outer tubular shaped elements and pushing the pressure platen onto the outer tubular shaped elements by means of pressure wedges.

10. A process according to claim 8, wherein said pressure platen is moved onto the overlapping ends of said inner and outer tubular shaped elements by holding the heat exchanger by an anvil and pushing the pressure platen onto the outer tubular shaped element by means of a punch.

11. A process for the manufacture of a heat exchanger according to claim 8, wherein the set of tubular elements passed through the orifices of the pressure piston is the set of inner tubular shaped elements.

* * * * *